US010443945B2

(12) United States Patent
Goel et al.

(10) Patent No.: US 10,443,945 B2
(45) Date of Patent: Oct. 15, 2019

(54) ADJUSTABLE MULTI-PASS HEAT EXCHANGER

(71) Applicant: Lennox Industries Inc., Richardson, TX (US)

(72) Inventors: Rakesh Goel, Irving, TX (US); Mark Olsen, Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 542 days.

(21) Appl. No.: 14/643,811

(22) Filed: Mar. 10, 2015

(65) Prior Publication Data

US 2015/0260458 A1 Sep. 17, 2015

Related U.S. Application Data

(60) Provisional application No. 61/951,857, filed on Mar. 12, 2014.

(51) Int. Cl.

| | |
|---|---|
| ***F28D 1/04*** | (2006.01) |
| ***F28D 1/053*** | (2006.01) |
| ***F25B 39/04*** | (2006.01) |
| ***F28F 9/02*** | (2006.01) |
| ***F28F 27/02*** | (2006.01) |
| *F28D 21/00* | (2006.01) |

(52) U.S. Cl.

CPC ..... *F28D 1/05391* (2013.01); *F25B 39/04* (2013.01); *F28D 1/05325* (2013.01); *F28F 9/028* (2013.01); *F28F 27/02* (2013.01); *F25B 2400/075* (2013.01); *F25B 2600/05* (2013.01); *F25B 2600/2515* (2013.01); *F28D 2021/007* (2013.01)

(58) Field of Classification Search

CPC ..... F28F 27/02; F28F 9/028; F28F 9/0265; F28D 1/05391; F28D 1/05325; F28D 1/05341; F25B 39/04; F25B 2600/2515

See application file for complete search history.

(56) References Cited

U.S. PATENT DOCUMENTS

| | | | | | |
|---|---|---|---|---|---|
| 2,998,227 | A * | 8/1961 | Gaston | F28B 7/00 | 165/143 |
| 3,047,274 | A * | 7/1962 | Wilson | F28D 7/022 | 165/101 |
| 3,481,152 | A * | 12/1969 | Seeley | F24F 5/00 | 62/183 |
| 3,704,747 | A * | 12/1972 | Andoniev | C21B 7/10 | 122/7 R |
| 3,774,678 | A * | 11/1973 | Glorisi | B60K 11/02 | 137/510 |
| 3,789,919 | A * | 2/1974 | Huber | F28B 1/06 | 165/101 |
| 4,050,506 | A * | 9/1977 | Small | F25J 1/0022 | 165/295 |

(Continued)

*Primary Examiner* — Travis C Ruby

(74) *Attorney, Agent, or Firm* — Baker Botts L.L.P.

(57) ABSTRACT

An air conditioner includes a heat exchanger having one or more flow paths. At least one of the flow paths is associated with more than one pass and/or fluid flow through the flow path is restricted. A setting of the beat exchanger includes associations between flow path(s) and/or pass(es). A setting for the heat exchanger is determined and the heat exchanger is allowed to operate in the determined setting.

15 Claims, 8 Drawing Sheets

(56) References Cited

U.S. PATENT DOCUMENTS 4,738,309 A * 4/1988 Schilling ..... F28D 7/08 165/101
4,798,242 A * 1/1989 Kito ..... F28F 27/02 165/101
4,991,643 A * 2/1991 Price ..... F28F 27/02 165/101
5,101,640 A * 4/1992 Fukushima ..... F25B 49/027 165/101
5,168,920 A * 12/1992 Brauer ..... C12C 13/02 165/100
5,305,826 A * 4/1994 Couetoux ..... F01P 7/16 123/41.08
5,452,686 A * 9/1995 Stahl ..... F22B 1/1884 122/135.1
5,968,312 A * 10/1999 Sephton ..... B01D 1/065 159/18
6,059,026 A * 5/2000 Bailly ..... F25B 39/028 165/158
6,237,677 B1 * 5/2001 Kent ..... F25B 39/04 165/110
6,253,840 B1 * 7/2001 Kuroyanagi ..... F28D 1/0333 165/153
6,557,371 B1 * 5/2003 Judge ..... F25B 31/004 165/110
7,322,399 B2 * 1/2008 Guerrero ..... F28D 1/0452 165/101
8,235,101 B2 * 8/2012 Taras ..... F25B 13/00 165/101
9,638,470 B2 * 5/2017 Dziubinschi ..... F28D 1/05316
2003/0047300 A1 * 3/2003 Okumura ..... B60H 1/00028 165/42
2004/0013585 A1 * 1/2004 Whyatt ..... B01B 1/005 422/177
2004/0069477 A1 * 4/2004 Nishikawa ..... F28D 1/0391 165/175
2006/0191677 A1 * 8/2006 Viczena ..... F24F 11/06 165/260
2006/0236718 A1 * 10/2006 Lundberg ..... F28D 1/05391 62/515
2008/0296005 A1 * 12/2008 Taras ..... F25B 13/00 165/173
2009/0166022 A1 * 7/2009 Desai ..... F28D 1/0443 165/279
2009/0183867 A1 * 7/2009 Bales ..... F28D 7/1607 165/299
2010/0206535 A1 * 8/2010 Munoz ..... F25B 39/028 165/173
2012/0111535 A1 * 5/2012 Jukkola ..... F28C 3/14 165/104.18
2015/0021003 A1 * 1/2015 Cho ..... F28F 9/0212 165/145
2015/0114030 A1 * 4/2015 Park ..... F25B 39/00 62/507
2015/0176925 A1 * 6/2015 Tylutki ..... F28F 5/00 165/96
2015/0247678 A1 * 9/2015 Tylutki ..... F28D 1/05325 165/103
2015/0300744 A1 * 10/2015 Goel ..... F28F 9/028 165/166

* cited by examiner

ADJUSTABLE MULTI-PASS HEAT EXCHANGER

CROSS REFERENCE TO RELATED INFORMATION

This application claims the benefit of U.S. Provisional Patent Application No. 61/951,857, filed Mar. 12, 2014, titled Adjustable Multi-pass Heat Exchanger, the contents of which are hereby incorporated herein in its entirety.

TECHNICAL FIELD

The present disclosure is directed to heat exchangers, and more particularly to adjustable heat exchangers.

BACKGROUND OF THE INVENTION

Heat exchangers are often used as condensers and evaporators in air conditioning systems. The heat exchanger selected for a particular application is often based on a high load or an average load. Thus, when a system operates outside the condition for which it was designed, the heat exchanger may encounter problems (e.g., vapor provided in a liquid exit line, liquid provided in a vapor exit line, etc.) and/or an efficiency of the system may be less than optimal.

Another problem is that two-speed or variable heat exchangers may be able to run in high and low running states but do not normally use a variable charge (the level of refrigerant). The charge may be set for a value between the high and low states because the amount of refrigerant cannot be changed easily. As a result the amount of charge may not be chosen for the greatest efficiency. An inappropriate charge level can lead to excess gas and/or fluid in a system. In practice, because the charge level cannot be changed easily, heating and cooling systems are built to handle some excess gas and/or fluid depending on the high and low running states and the desired charge. Even so, these inefficiencies can lead to unwanted mechanical failures and inefficient use of resources or energy.

Another problem in the prior art is that, when a system is operating outside of a desired range or inefficiently, a mix of liquid and gas may pass through the heat exchanger. Certain portions of manifolds, along the edges of a heat exchanger may need certain amounts of liquid to collect at certain portions. And when insufficient or excess liquid collects it can cause problems in the system. With insufficient cooling, excess gas may be left in the system and may collect in certain areas of the system. This increases the likelihood of mechanical failure.

Because heat exchangers can have circuitry set for a given load, they can be ill equipped to handle variable loads. It would be great to have a heat exchanger with modifiable circuitry so that it can handle variable loads. A heat exchanger is needed that can handle variable loads and would thereby help solve the other problems described above.

BRIEF SUMMARY OF THE INVENTION

The disclosure provides a heat exchanger with the ability to handle a variable flow rate on a constant charge. One advantage is a heat exchanger capable of adjusting to various parameters without needing to adjust the charge. Another advantage is a mechanism to separate gas from liquid within a heat exchanger.

One embodiment comprises: an inlet; a first plurality of channels operable to receive a fluid from the inlet; a first manifold, the manifold providing a connection between the first plurality of channels, the first manifold including: a plurality of adjustable valves connected to at least one of the first plurality of channels, the plurality of adjustable valves operable to alter the number of the first plurality of channels forming a first pass through the multi-pass heat exchanger; and a second manifold receiving the fluid from the first plurality of channels and directing the fluid to a second plurality of channels for a second pass through the multi-pass heat exchanger.

Another embodiment comprises a multi-pass heat exchanger comprising: a fluid inlet; a first manifold operable to receive fluid from the fluid inlet; a second manifold operable to direct fluid from a first pass to a second pass; a first plurality of channels connecting the first and second manifolds and operable to allow airflow around the exterior of each channel, the first plurality of channels comprising the first pass; a second plurality of channels connecting the first and second manifolds and operable to allow airflow around the exterior of each channel, the second plurality of channels comprising the second pass; and an adjustable valve, the adjustable valve operable to add at least one of the first plurality of channels to the second plurality of channels.

Another embodiment is a method of condensing fluid, comprising: determining a flow rate to a heat exchanger that comprises a plurality of fluid channels; based on the flow rate, selecting a first plurality of fluid channels to be a first pass and selecting a second plurality of fluid channels to be a second pass; adjusting valves in the heat exchanger to direct a fluid along the first and second passes.

The details of one or more implementations are set forth in the accompanying drawings and the description below. Other features, objects, and advantages of the implementations will be apparent from the description and drawings.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Heat exchangers may be utilized in a variety of applications. Air conditioners may, for example, provide cooled and/or heated air to a location; provide cooled and/or heated air in vehicles (e.g., cars, trucks, boats, recreational vehicles); and/or provide dehumidified air. In some implementations, air conditioners, including heat pumps, may utilize heat exchangers as condensers and/or evaporators. Refrigeration units may utilize heat exchangers (e.g., as condensers and/or evaporators) to provide cooled and/or dehumidified air to a refrigeration area.

In various implementations, a heat exchanger may be utilized that allows a number of passes and/or a number of flow paths utilized per pass to be adjusted. By allowing customization of flow path usage in a heat exchanger, performance of the heat exchanger and/or properties of streams) leaving the heat exchanger may be controlled.

Figure 1A:
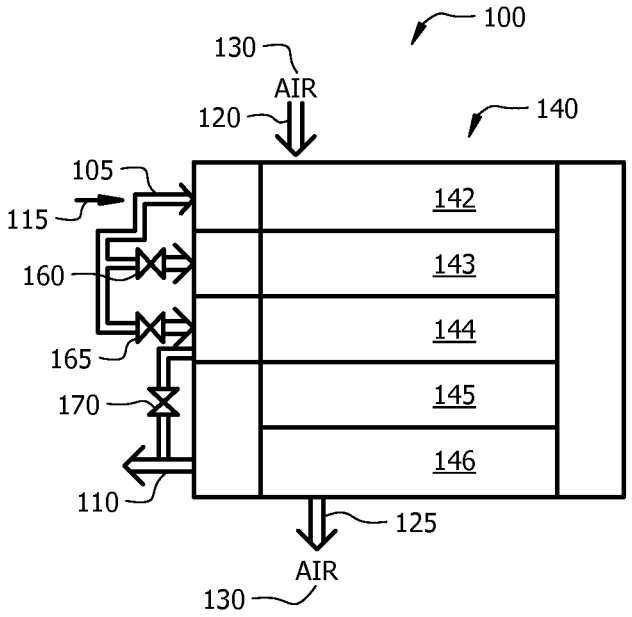
FIG. 1A illustrates an implementation of an example heat exchanger.

FIG. 1A illustrates an embodiment of a heat exchanger 100. In most embodiments the fluid within the heat exchanger will be refrigerant and airflow will pass around and over the heat exchanger. However, other embodiments can use other fluids to flow around the heat exchanger. In some embodiments another fluid instead of air will be used and some embodiments will use another liquid such as refrigerant to flow around the heat exchanger.

FIG. 1A illustrates a heat exchanger 100. The heat exchanger 100 includes a first inlet 105 and a first outlet 110 for a first fluid 115, such as refrigerant (e.g., R-410A and/or a mixture of two or more types of refrigerant). The first fluid 115 may be provided to the first inlet 105 from another component of the system in which the heat exchanger is used. For example, the discharge line from compressor(s) may be coupled to an inlet of the heat exchanger. The outlet of the heat exchanger may be coupled to other components of the system in which the heat exchanger resides, such as an expansion device. The first fluid may be allowed to flow through two or more passes in the heat exchanger.

The heat exchanger 100 includes a second inlet 120 and a second outlet 125 for air to flow over the heat exchanger (in most implementations the air will be moving in a direction perpendicular to the image, i.e. towards or away from the reader). Air will flow over the heat exchanger in most embodiments, but other possible configurations could involve a liquid such as refrigerant or another fluid. In some implementations, the air may be allowed to flow in a single pass and/or more than one pass in the heat exchanger. A fan may be disposed proximate the heat exchanger 100 to provide a stream of air 130. The fan may provide air to the second inlet and the processed air may exit the second outlet of the heat exchanger.

The heat exchanger 100 may include one or more manifolds 135. A manifold 135 may provide fluid to one or more fluid paths of the heat exchanger 100. As illustrated, the first fluid 115 may flow from a first inlet 105 into a first set of manifolds 137. A second set of manifolds 138 may be disposed between the first pass and the second pass. In most embodiments there will be airflow around the exterior of the manifolds and fluid paths.

The heat exchanger 100 may include one or more flow paths 140 for the first fluid, in various implementations. As illustrated, the heat exchanger 100 includes five flow paths, first flow path 142, second flow path 143, third flow path 144, fourth flow path 145, and fifth flow path 146.

Each flow path may include one or more conduits through which the first fluid may flow, in some implementations. For example, a flow path may include at least ten conduits. The conduits may be the tubes in a tube and fin heat exchanger, the tubes in a shell heat exchanger, and/or other types of heat exchangers. The tube(s) may include any appropriate material, such as copper. In some implementations, one or more of the conduits may be housed in a second larger conduit.

One or more of the flow paths may be used for the first pass and/or any additional passes, such as the second pass. The first fluid may flow from the first fluid inlet to the first pass (e.g., via a first set of manifolds) and through the first pass to a second pass (e.g., via a second set of manifolds). The heat exchanger 100 may be capable of adjusting which flow paths are utilized with a specific pass and/or restricting flow through one or more of the flow paths.

Figure 1B:
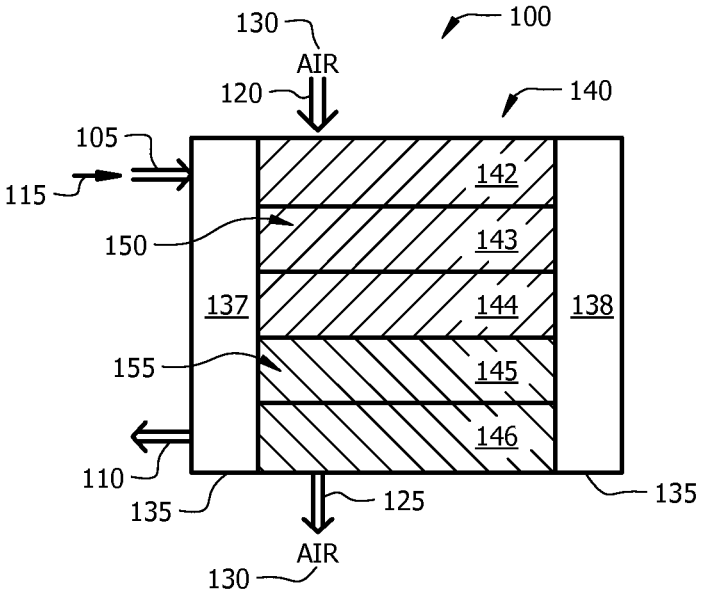
FIG. 1B illustrates an implementation of an example heat exchanger.
Figure 1C:
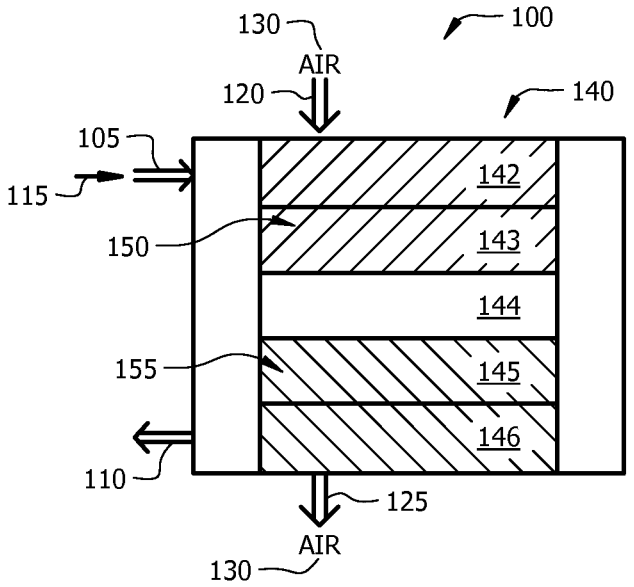
FIG. 1C illustrates an implementation of an example heat exchanger.
Figure 1D:
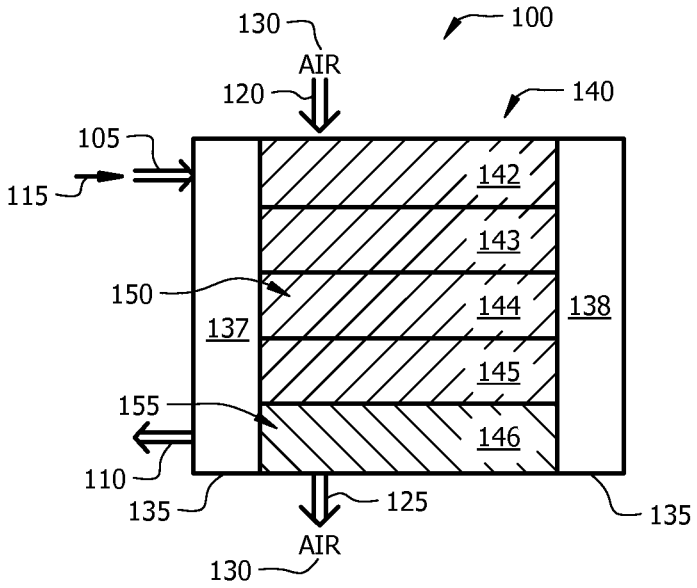
FIG. 1D illustrates an implementation of an example heat exchanger.

As illustrated in FIG. 1B, the first pass 150 may include the first flow path 142, the second flow path 143, and the third flow path 144 and the second pass 155 may include the fourth flow path 145 and the fifth flow path 146. In some implementations, the heat exchanger 100 may adjust the flow paths utilized with the first and/or second pass. As illustrated in FIG. 1C, the first pass 150 may include the first flow path 142 and the second flow path 143 and the second pass 155 may include the fourth flow path 145 and fifth flow path 146. The fluid flow through the third flow path 144 may be restricted. As illustrated in FIG. 1D, the first pass 150 may include the first flow path 142, the second flow path 143, the third flow path 144, and the fourth flow path 145, and the second flow pass 155 may include the fifth flow path 146.

In some implementations, a heat exchanger may include settings. Each setting may include an association between one or more of the flow paths and one or more of the passes. Flow through one or more of the flow paths may be restricted in some implementations of settings. For example, the implementation illustrated in FIG. 1B may be associated with a first setting, the implementation illustrated in FIG. 1C may be associated with a second setting, and/or the implementation illustrated in FIG. 1D may be associated with a third setting. As illustrated, adjustment of one or more flow paths, such as the first flow path and/or the fifth flow path may be restricted from being adjusted. In some implementations, one or more flow paths may be adjusted from being associated with a first pass to a second pass and/or vice versa. In some implementations, fluid flow through one or more flow paths may be restricted and/or the flow path(s) may be associated with one or more of the passes.

The heat exchanger may include one or more valves coupled to the first fluid inlet and/or the first fluid outlet to control fluid flow (e.g., direction of fluid flow). The valves may include any appropriate valve, such as solenoid valves, directional valves (e.g., three-way valves and/or four-way valves), electronically operated valves, and/or any other appropriate type of valve. As illustrated in FIG. 1A, the heat exchanger includes valves, such as a first valve 160 and a second valve 165, and/or a third valve 170. The valves may be opened and/or closed to manage fluid flow. For example, when the first valve 160 is open, fluid may flow from the first inlet 105 through the second flow path to the second set of manifold 138. When a second valve 165 is closed, fluid flow from the first inlet 105 through the third flow path is restricted. When a third valve 170 is opened, fluid flow through the third flow path 144 to the first fluid outlet may be allowed (e.g., the third flow path is a portion of the second pass). The valves may control whether fluid flow through a fluid path is allowed in a specified direction (e.g., to act as at least a portion of the first pass and/or second pass) and/or whether fluid flow is restricted. Thus, when a heat exchanger is adjusted from a first setting to a second setting, the position of the appropriate valves may be adjusted (e.g., a controller may transmit signals to the valve(s) to open and/or close based on a setting).

Although FIGS. 1A-1D illustrates a specific implementation of a heat exchanger, other implementations may be utilized. For example, the heat exchanger may include any appropriate number of flow paths, such as more than five flow paths. The flow paths of the heat exchanger may be associated with any appropriate number of passes, such as more than three passes. In some implementations, one or more flow paths may be restricted from being utilized with one or more of the passes. For example, the first flow path may be utilized by the first pass and restricted from being utilized by the second pass. In some implementations, the fifth flow path may be utilized by the second pass and restricted from being utilized by the first pass. In some implementations, one or more flow paths may be utilized with more than one pass or with none of the passes (e.g., fluid flow through the flow path may be restricted). Each of the flow paths may be associated with a single pass in some implementations. In some implementations, a heat exchanger may include a plurality of settings. A setting may associate each flow path with either a pass (e.g., first pass, second pass, and/or third pass) or restrict fluid from flowing through the flow path. A heat exchanger may be adjusted by allowing the heat exchanger adjusting at which setting the heat exchanger is allowed to operate. A controller may utilize a setting (e.g., information about a setting, such as associations between flow paths and/or passes) to determine which valve settings (e.g., position) to adjust.

In some implementations, a controller (e.g., of the heat exchanger and/or system in which the heat exchanger operates) may be coupled to and/or may be a portion of the heat exchanger (e.g., to manage operations of the heat exchanger). The controller may be any appropriate programmable logic device, such as a computer. The controller may include a memory to store data (e.g., setting information, criteria to facilitate determinations of which settings to utilize and/or when to adjust settings, and/or any other appropriate data) and instructions. The controller may include a processor to execute the instructions (e.g., a module) stored in the memory. For example, the controller may include operation module(s) that allow operation of the heat exchanger and/or other components coupled to the controller. The controller may include an adjustment module (s) that evaluates input, such as settings of components coupled to the controller and/or properties of fluid in an inlet of a heat exchanger; determines which settings to allow (e.g., based on evaluated input); determines whether to adjust a setting of a heat exchanger based on the evaluation; determines whether valve positions should be adjusted; adjusts valve positions based on a setting; allows operation of the heat exchanger based on a setting; and/or other appropriate operations.

Figure 2:
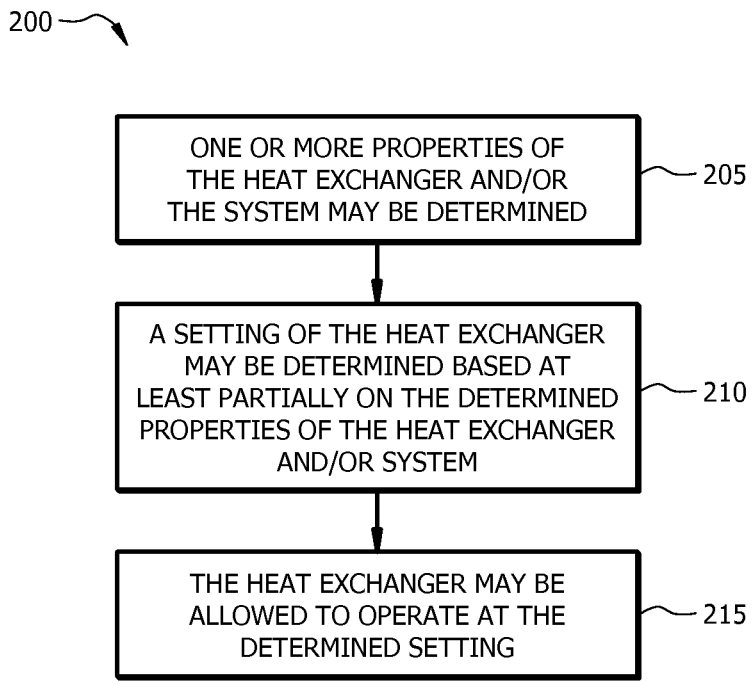
FIG. 2 illustrates an implementation of an example process for operation of a heat exchanger.

FIG. 2 illustrates an implementation of an example process 200 for operation of a heat exchanger in a system, such as the heat exchanger illustrated in FIG. 1A. One or more properties of the heat exchanger and/or the system (e.g., of which the heat exchanger is a component) may be determined (operation 205). For example, one or more properties (e.g., a pressure, temperature, and/or flow rate) of a first fluid in a first inlet may be determined. In some implementations, such as in a refrigeration system, a setting (e.g., full load, part load, and/or number of units operating) of compressor (s) of the system may be determined.

A setting of the heat exchanger may be determined based at least partially on the determined properties of the heat exchanger and/or system (operation 210). A heat exchanger may have two or more settings. For example, in a first setting of a heat exchanger, a first fluid may flow in a first set of flow paths for a first pass and exit the first pass to flow into a second pass that includes a second set of flow paths. In a second setting of a heat exchanger, the first fluid may flow into a third set of flow paths for the first pass and exit the first pass to flow into a second pass that includes a fourth set of flow paths. A controller may determine which of the settings of the heat exchanger should be allowed by retrieving associations between settings and properties of the system.

The heat exchanger may be allowed to operate in the determined setting (operation 215). For example, if a determination is made to utilize the first setting, then the heat exchanger may be allowed to operate at the first setting. The valves of the heat exchanger may be adjusted, in some implementations, to allow the fluid flow of the first setting. For example, valve(s) allowing fluid flow from the first fluid inlet through a first path, second path, and third path may be opened and valves allowing fluid from the first fluid inlet to the fourth path and fifth path may be closed (e.g., to restrict fluid flow).

Process 200 may be implemented by various systems, such as system 100. In addition, various operations may be added, deleted, and/or modified. For example, one or more properties (e.g., a pressure, temperature, and/or flow rate) of a first fluid in at least a portion of the second manifold may be determined. A setting may be selected based at least partially on whether one or more of the determined fluid properties are within a predetermined first fluid range (e.g., vapor/liquid ratio range, degree of homogeneity range; temperature range and/or pressure range). Thus, for example, if the degree of homogeneity (e.g., a measure of the dispersal of vapor in a liquid) of a first fluid in the second manifold is not within a predetermined degree of homogeneity, then the setting may be adjusted. In some implementations, the heat exchanger may include more or fewer valves to control fluid flow and/or to associate flow paths with pass(es) in the heat exchanger.

Figure 3:
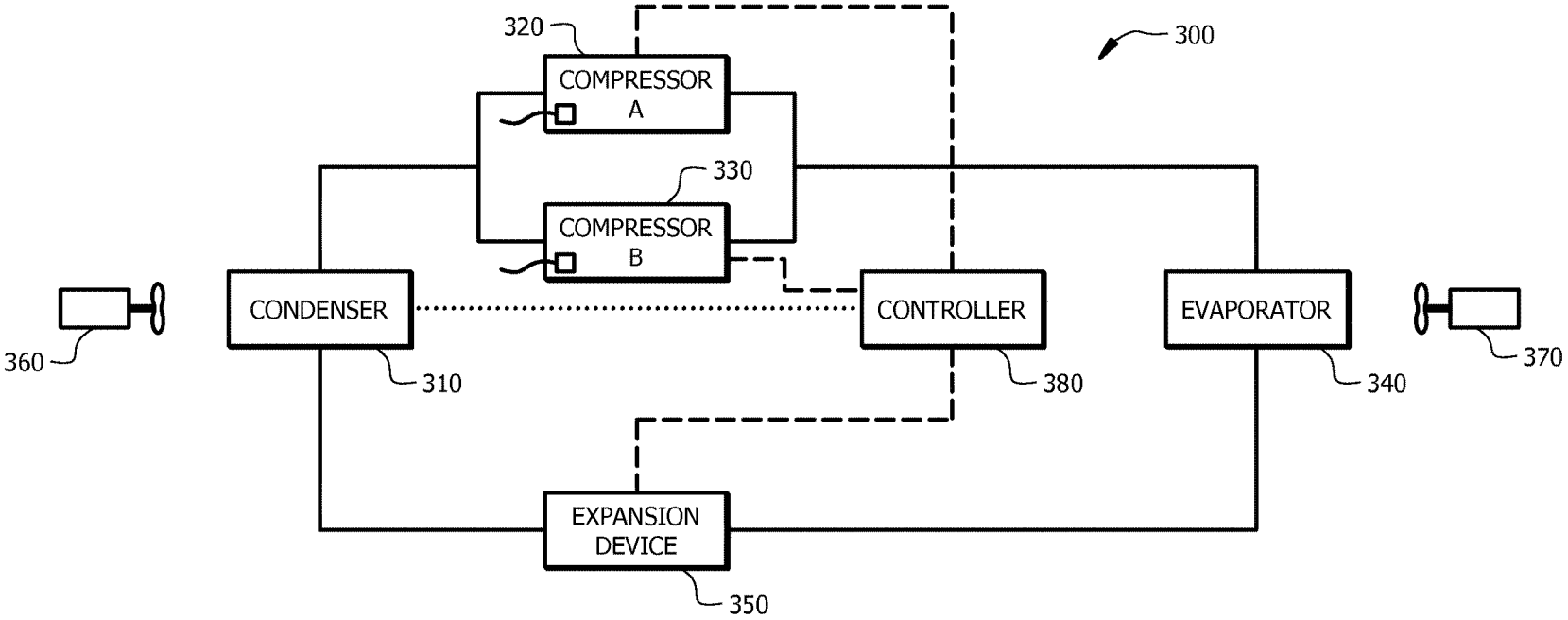
FIG. 3 illustrates an implementation of an example air conditioner.

In various implementations, the described heat exchanger may be utilized in a variety of systems. For example, the heat exchanger may operate as a condenser and/or evaporator in an air conditioning system and/or refrigeration system. For example, FIG. 3 illustrates an implementation of an example air conditioner 300. The condenser and/or evaporator may be a heat exchanger as illustrated in FIGS. 1A-1D, in some implementations.

FIG. 3 illustrates an implementation of an example air conditioner 300. The air conditioner may include components such as a condenser 310, compressor A 320, compressor B 330, evaporator 340, and expansion device 350. Lines (e.g., tubing) may couple various components and allow refrigerant to flow in and/or out of various components of the air conditioner 300.

Fans 360, 370 may cause air to flow through the condenser 310 and/or the evaporator 340. As illustrated, the air conditioner 300 may include more than one fan to provide air flow to the condenser 310 and/or more than one fan to provide air flow to the evaporator 340. The air conditioner 300 may include a first condenser fan, a second condenser fan, and a third condenser fan to provide air flow to the condenser 310 and a first evaporator fan, a second evaporator fan, and a third evaporator fan to provide air flow to the evaporator 340, in some implementations.

The condenser 310 may include an appropriate condenser. In some implementations, the condenser 310 may be a microchannel condenser (e.g., condenser with a channel size less than approximately 1 mm). MicroChannel condensers may be more sensitive to operating conditions than other condensers (e.g., condenser with tube size greater than 5 mm). For example, microchannel condensers may be sensitive to refrigerant charge (e.g., a level of refrigerant in the system). When a microchannel condenser has a refrigerant charge greater than a maximum operating charge, the pressure in the microchannel condenser may become elevated due to the refrigerant capacity size difference between the microchannel condenser and the evaporator. The high pressures (e.g., pressures greater than approximately 615 psi, with a refrigerant that includes R-410A refrigerant) may cause mechanical failure, including prefailure events, such as excessive wear on parts and/or high pressure switch activations.

Figure 4A:
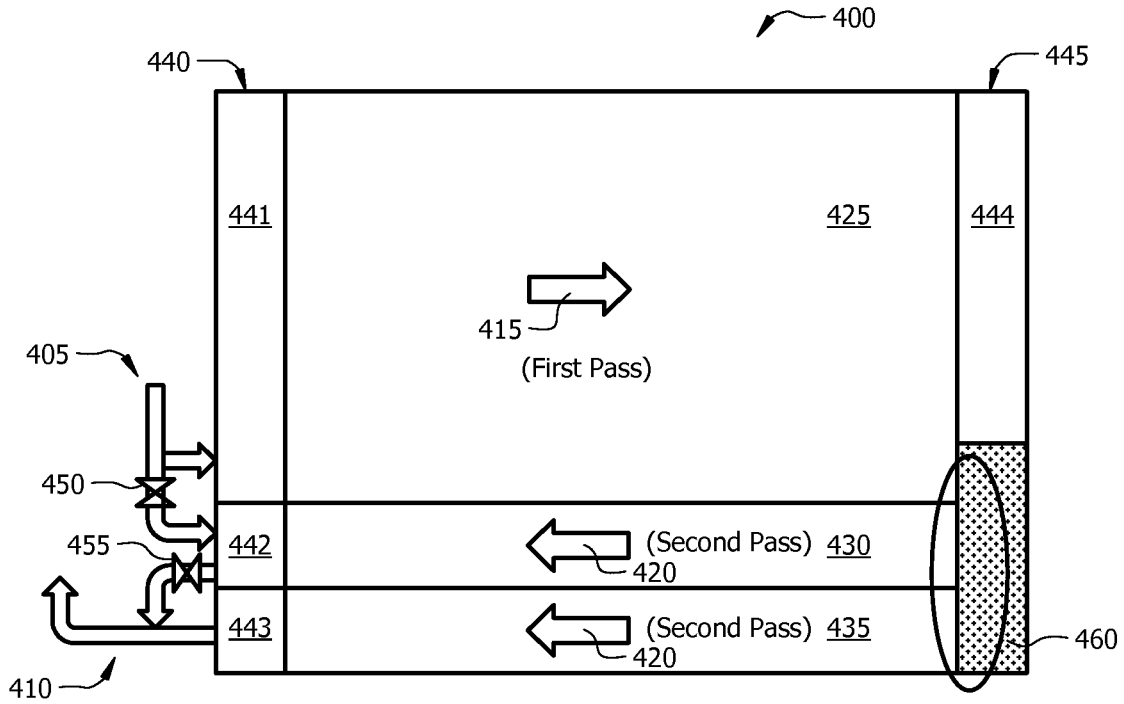
FIG. 4A illustrates an implementation of an example heat exchanger.
Figure 4B:
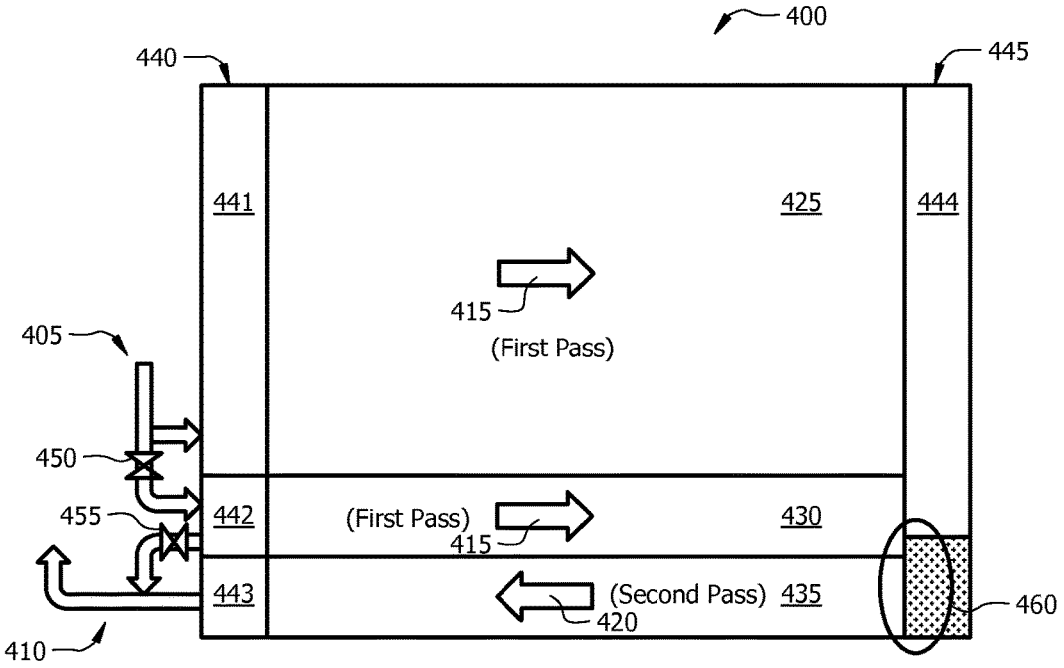
FIG. 4B illustrates an implementation of an example heat exchanger.
Figure 4C:
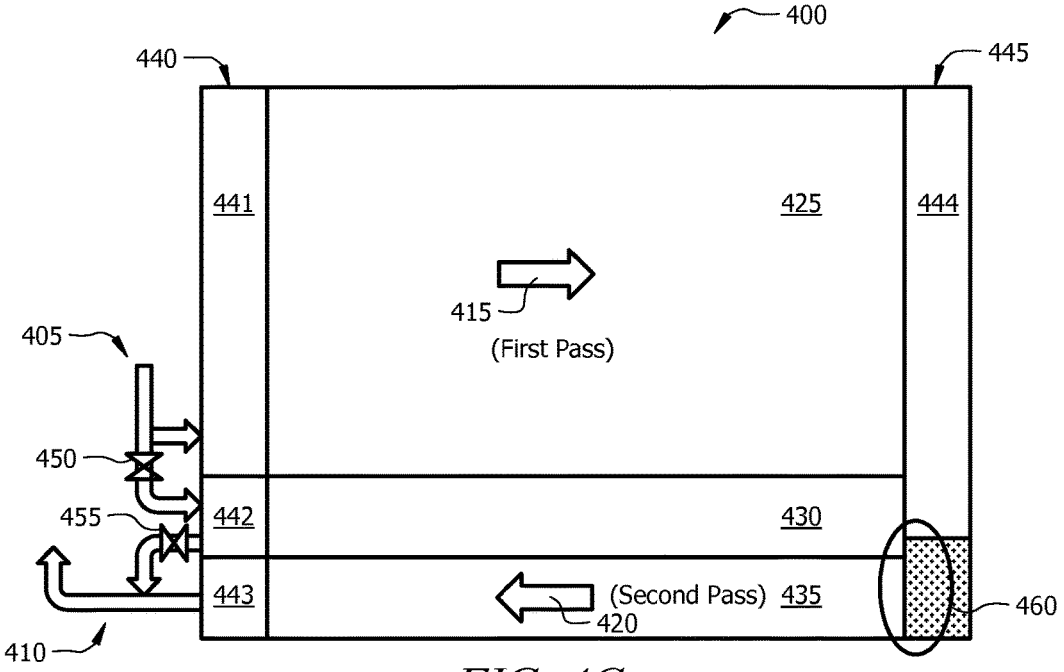
FIG. 4C illustrates an implementation of an example heat exchanger.

The condenser 310 and/or the evaporator 340 may also include one or more of the features of the heat exchangers described in FIGS. 1A-1D. For example, the condenser 310 may include a heat exchanger, as illustrated in the implementation of an example condenser 400 illustrated in FIGS. 4A, 4B, and 4C. FIG. 4A illustrates an implementation of an example condenser 400 at a first setting and FIG. 4B illustrates an implementation of an example condenser 400 at a second setting. FIG. 4C illustrates an implementation of an example condenser 400 at a third setting.

As illustrated, the condenser 400 includes a first fluid inlet 405 that couples the discharge line from the compressor(s) to the condenser. The condenser 400 also includes a first fluid outlet line 410 that couples the first fluid outlet to the expansion valve.

The condenser 400 includes two passes, a first pass 415 and a second pass 420. The condenser 400 includes a first flow path 425, a second flow path 430, and a third flow path 435. When the first fluid, such as refrigerant, flows from the compressor discharge line to the first pass 415, it passes through a first set of manifolds 440 prior to entering the first pass. Then the refrigerant exits the first pass and enters a second set of manifolds 445. The refrigerant passes through the second set of manifolds to the second pass 420. As illustrated, the first set of manifolds includes a manifold coupled to each of the flow paths and the second set of manifolds includes manifolds coupled to one or more of the flow paths. In the first set of manifolds, the first manifold 441 is coupled to the first flow path 425, the second manifold 442 is coupled to the second flow path 430, and the third manifold 443 is coupled to the third flow path 435. In the second set of manifolds, the fourth manifold 444 is coupled to the first flow path 425, the second flow path 430, and the third flow path 435.

The heat exchanger 400 may include valves to control the direction of fluid flow in one or more of the flow paths. As illustrated, a first valve 450 may be positioned in the line that couples the compressor discharge line 405 to the second flow path 430. A second valve 455 may be positioned in the line that couples the second flow path 430 to the first fluid outlet line 410. When the first valve 450 is open, the refrigerant may be allowed to flow from the compressor discharge line to the second flow path 430 (e.g., via the second manifold 442); and when the first valve 450 is closed, refrigerant is restricted from flowing from the compressor discharge line to the second flow path 430. When the second valve 455 is open, fluid may flow from the second flow path 430 to the first fluid outlet 410 (e.g., via the second manifold 442); and when the second valve 455 is closed, fluid in the second flow path 430 may be restricted from flowing into the first fluid outlet line 410.

As illustrated in FIG. 4A, in the first setting, the first pass 415 includes the first flow path 425, and the second pass 420 includes the second flow path 430 and the third flow path 435. The first setting may be used when the compressor(s) are operating at full load. When refrigerant enters the second set of manifolds 445 (e.g., after being processed through the first pass 415), the refrigerant may include a mixture of vapor and liquid refrigerant. In the second pass 420, the refrigerant may be further liquefied. When the compressor (s) are allowed to operate at a full load setting, the mixture 460 entering the second pass may have properties within a predetermined refrigerant property range. For example, the refrigerant may have a degree of homogeneity within a predetermined homogeneity range. The refrigerant may have a ratio of vapor to liquid within a predetermined range and/or the refrigerant may have other properties (e.g., temperature and/or pressure) within a predetermined property range.

As illustrated in FIG. 4B, in the second setting, the first pass 415 includes the first flow path 425 and the second flow path 430 and the second pass 420 includes the third flow path 435. The second setting may be used, for example, when the compressor(s) are operating at part load. In some implementations, if the first setting was utilized rather than the second setting, the mixture entering the second pass 420 may not have a property (e.g., pressure, temperature, degree of homogeneity) within a predetermined property range.

As illustrated in FIG. 4C, in the third setting, the first pass 415 includes the first flow path 425, and the second pass 420 includes the third flow path 435. Fluid flow through the second flow path 430 may be restricted. The third setting may be used, for example, when the compressor(s) are operating at part load. In some implementations, if the first setting or second setting was utilized rather than the third setting, the mixture entering the second pass 420 may not have a property (e.g., pressure, temperature, degree of homogeneity) within a predetermined property range.

As illustrated in FIG. 3, fan 360 may provide air flow to the condenser 310 and fan 370 may provide air flow to the evaporator 340. The fans 360, 370 may include any appropriate number of fans, such as one, two, or another number. Fans 360, 370 may be any appropriate type of fan, such as a centrifugal fan. A fan may include more than one fan setting. For example, the fan may be a multi-speed fan (e.g., one or more settings) and/or a variable speed fan. For example, a fan may allow operation at 800 RPM (rotations per minute), 650 RPM, and/or 330 RPM. In some implementations, a fan may include a low setting and more than one high setting.

The compressors 320, 330 of the air conditioner may include any appropriate arrangement of compressors (e.g., in series and/or in parallel). The compressors 320, 330 may include a tandem compressor system. The tandem compressor system may allow more than one compressor (e.g., compressor A 320 and compressor B 330) to share discharge lines and suction lines.

Compressor A 320 and/or compressor B 330 may include single stage and/or multi-stage (e.g., more than one stage, such as two stage, three stage, and/or variable) compressors. Compressor A 320 and Compressor B 330 may be independently operable, in some implementations. For example, compressor A 320 may be allowed to operate and compressor B may be restricted from operation. Operations of the compressors may include full load operations and part load operations. A full load operation may include operation of each compressor of the air conditioner. A part load operation may include allowing operation of one or more compressors and restricting operation of one or more compressors. For example, a part load operation may allow one compressor to operate and restrict operation of the other compressors.

The air conditioner may include an expansion device 350, as illustrated. The expansion device may include any device that at least partially expands refrigerant passing through the device. For example, the expansion device 350 may include a thermal expansion valve, an orifice, and/or an electronic expansion valve.

A controller 380 (e.g., a computer or server) may be coupled (e.g., communicably, such as by wires or linked by Wi-Fi) to component(s) of the air conditioner 300 and control various operations of the component(s) and/or system. For example, the controller 380 may include modules (e.g., instructions executed by a processor of the controller), such as an operation module and/or an adjustment module, stored in a memory of the controller and executable by a processor of the controller, to perform various operations of the air conditioner 300. The operation module may control operations of the air conditioner 300, such as receiving requests for operation, determining whether to respond to requests for operation, operating various components (e.g., compressors, reversing valves, and/or expansion valves), etc. The adjustment module may operate one or more components of the air conditioner, measure and/or determine one or more properties of the system or portions thereof, determine whether changes have occurred, retrieve tables of associations (e.g., to associate a change detected with criteria for determining whether to determine a heat exchanger setting and/or tables that associate properties with settings of the heat exchanger, determine settings, determine whether to allow adjustments to settings, compare one or more values, and/or allow operation of a component at a setting). For example, the adjustment module may determine properties of the air conditioner (e.g., ambient temperature, temperature proximate a portion of the air conditioner, pressure of at least a portion of the air conditioner), retrieve one or more predetermined values for properties, determine a setting of a heat exchanger, adjust a configuration of a heat exchanger based on a determined setting, allow operation of the heat exchanger at the setting, and/or any other appropriate operation.

The controller 380 may include a memory that stores the modules (e.g., instructions) and/or other data. For example, the memory may store predetermined property values (e.g., temperature, compressor load values, property, vapor pressure, vapor to liquid ratios, and/or any other appropriate value); criteria; tables of associations (e.g., between changes, properties, and/or compressor settings and heat exchanger settings); and/or other appropriate data.

The controller 380 may include an input device such as a keyboard, touchscreen, on/off switch, rotary selector or other type of input mechanism. The input device can allow a user to select a temperature, a running level, or a variety of other settings.

Although FIG. 3 illustrates an implementation of an air conditioner, other implementations may be utilized as appropriate. For example, the air conditioner may include any component, as appropriate. The air conditioner in most embodiments will comprise an expansion device. The air conditioner may include more than two compressors (e.g., a tandem compressor with four compressors). The air conditioner may include one compressor, such as a two-stage compressor and/or a variable compressor. In some implementations, the expansion device may include more than one expansion device. The air conditioner may be a heat pump and may include a reversing valve to allow cooling and heating operations. The fans 360 and/or the fans 370 may include a different number or the same number of fans. In some implementations, one or more of the compressors may include a crankcase heater. In some implementations, systems other than heat exchangers may utilize one or more of the described features.

In some implementations, a portion of the air conditioner 300 may be disposed outside a building (e.g., an "outdoor portion" on the ground proximate a building and/or on a roof of the building) and a portion of the air conditioner may be disposed inside the building (e.g., an "indoor portion"). For example, the outdoor portion may include condenser 310 and fans 360 and the indoor portion may include the evaporator 340 and fans 370. In some implementations, such as a rooftop unit, the condenser 310, fans 360, compressor A 320, compressor B 330, evaporator 340, fans 370, and the expansion device 350 may be disposed in the outdoor portion. The outdoor and/or indoor portion may be at least partially disposed in housing(s).

During a cooling cycle of the air conditioner 300, cool air may be provided by blowing air (e.g., from fans 370) at least partially through the evaporator 340. The evaporator 340 may evaporate liquid refrigerant in the evaporator. The evaporator may reduce a temperature of the air and the cool air may be provided to a location (e.g., via ducting). The gaseous refrigerant may exit the evaporator 340, and may be compressed by compressor A 320 and compressor B 330, and delivered to a condenser 310. The condenser 310 may condense the gaseous refrigerant by blowing air (e.g., from fans 360) at least partially through the condenser 330 to remove heat from the gaseous refrigerant.

In various implementations, the second set of manifolds may include one or more mixing members. The mixing member(s) in a heat exchanger may be utilized in conjunction with or instead of flow paths that may be utilized with more than one pass and/or may be restricted from use. For example, the mixing members may be disposed at least partially in the second manifold and may facilitate obtaining a mixture 460, which may be provided to the second pass or other passes after the first pass, in a predetermined property range (e.g., by promoting mixing).

Although FIGS. 4A-4C illustrate implementations of example condensers, other implementations may be utilized. For example, one or more of the flow paths may be associated with a pass and alteration of the associated pass may be restricted. For example, a first fluid pass may be associated with a first pass and the first fluid pass may be restricted from being associated with other passes. In some implementations, the condenser may include more than two passes.

Figures 5A, 5B, 5C, 5D:
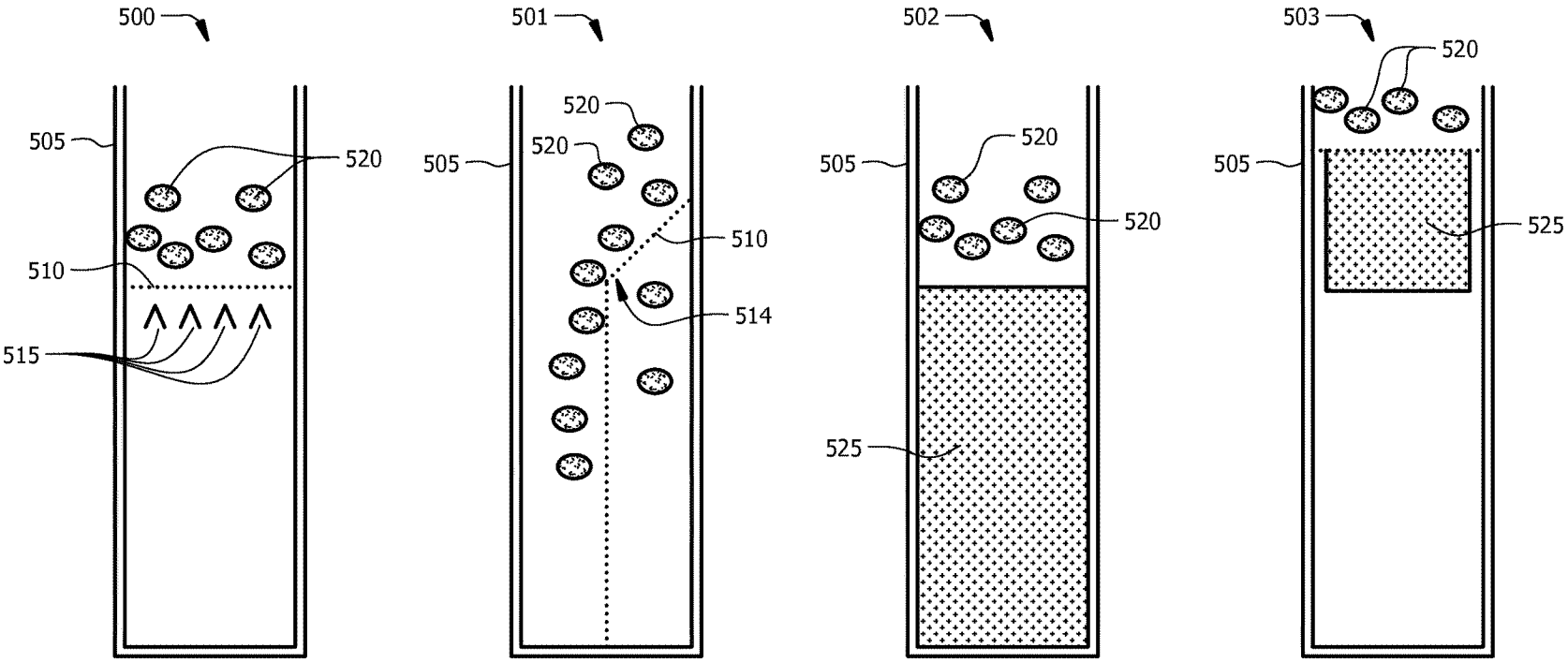
FIG. 5A illustrates an implementation of a portion of an example manifold.
FIG. 5B illustrates an implementation of a portion of an example manifold.
FIG. 5C illustrates an implementation of a portion of an example manifold.
FIG. 5D illustrates an implementation of a portion of an example manifold.

FIG. 5A illustrates an implementation of a portion 500 of an example manifold in the second set of manifolds. As illustrated, the manifold 505 includes a mixing member. The mixing member includes a perforated plate 510 and an agitator 515. The perforated plate 510 may extend across the manifold such that the fluid passes through the perforated plate to flow to the second pass. The position of the perforated plate may be selected to inhibit a quantity of vapor greater than a predetermined quantity (e.g., greater than 50% of the fluid entering tube in a flow path is vapor), in some implementations. As fluid enters the manifold 505, the liquid droplets 520 of fluid and the vapor are agitated by the agitator 515 to further the mixing of the liquid and vapor phases (e.g., to increase the degree of homogeneity) and pass through the perforated plate 510 to the second pass of the heat exchanger.

FIG. 5B illustrates an implementation of a portion 500 of an example manifold in the second set of manifolds. As illustrated, the manifold 505 includes a mixing member. The mixing member may include a perforated plate 510. The perforated plate 510 may include a sloped portion 512 and a planar portion 513. The perforated plate 510 may agitate and/or deflect the liquid droplets 520 of the fluid towards the second pass of the heat exchanger. Sloped portion 512 may also help to decrease the volume within manifold 505 as this may assist in maintaining the proper amount of fluid flow within the system.

FIG. 5C illustrates an implementation of a portion 500 of an example manifold in the second set of manifolds. As illustrated, the manifold 505 includes a mixing member. The mixing member may include a mesh portion 525. The mesh portion 525 may be disposed proximate the inlet of the second pass (e.g., the bottom portion of the manifold in the second set of manifolds in FIG. 1A). The mesh portion 525 may extend across a manifold 505 such that the fluid passes through the mesh portion to flow to the second pass, in some implementations. The mesh portion 525 may provide a larger surface area (e.g., when compared to implementations without a mesh portion) in which the liquid and vapor may interact and thus increase mixing (e.g., increase the degree of homogeneity).

FIG. 5D illustrates an implementation of a portion 500 of an example manifold in the second set of manifolds. As illustrated, the manifold 505 includes a mixing member. The mixing member may include a mesh portion 525. The mesh portion 525 may be disposed proximate the inlet of the second pass (e.g., the bottom portion of the manifold in the second set of manifolds in FIG. 1A). The mesh portion 525 may at least partially extend across a manifold 505 such that the fluid passes through the mesh portion to flow to the second pass. The mesh portion 525 may provide a larger surface area (e.g., when compared to implementations without a mesh portion) in which the liquid and vapor may interact and thus increase mixing (e.g., increase the degree of homogeneity). The mesh portion 525 may be agitated, in some implementations to increase mixing.

Although the mixing members are described in FIGS. 5A-5D as a portion of an adjustable heat exchanger, the mixing members may be utilized with other heat exchangers. For example, the heat exchanger may not be adjustable with respect to which flow paths are associated with which passes, but the heat exchanger may include one or more of the mixing members. In some implementations, one or more of the mixing members or portions thereof may be utilized in the same heat exchanger.

In various implementations, the heat exchanger may be utilized in applications in which the heat exchanger operates in a range of operating parameters. For example, when a system includes more than one compressor, a multi-speed compressor (e.g., two-stage compressor and/or variable compressors), variable second refrigerant flow rates (e.g., more than one fan and/or a multi-speed fan coupled to the heat exchanger to provide air as), and/or other changes in operating parameters, the setting of the heat exchanger may be determined and/or altered based on the changes in operating parameters. For example, a described heat exchanger may be utilized as a condenser in an air conditioner. The air conditioner may include more than one compressor (e.g., a tandem compressor) that operates at full load and/or part load(s). As the setting of the compressor changes (e.g., from full load to part load), properties of the fluid in the discharge line of the compressor changes and thus the conversion of vapor refrigerant to liquid refrigerant in the compressor may be affected.

Figure 6:
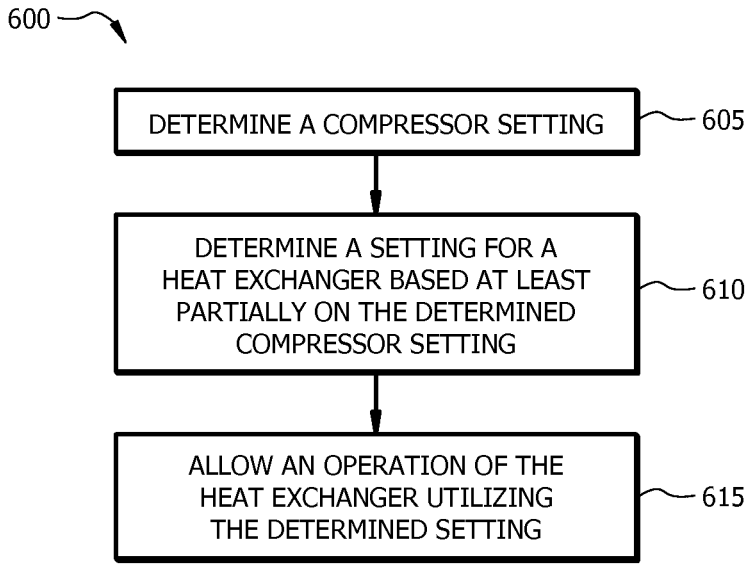
FIG. 6 illustrates an implementation of an example process for operation of a heat exchanger.

FIG. 6 illustrates an implementation of an example process 600 for use of a heat exchanger. A heat exchanger that has more than one setting may be utilized in a system, such as an air conditioner or refrigeration system. The heat exchanger with more than one setting may include one or more flow paths that may be utilized with more than one pass and/or through which fluid flow may be restricted. The heat exchanger may be coupled to a compressor outlet via the first fluid inlet and to an expansion valve inlet via the first fluid outlet. The heat exchanger may include a fan that provides a stream of air. The heat exchanger may operate to remove heat from the first fluid, refrigerant (e.g., a fluid that includes, but is not limited to, one or more types of refrigerant) to produce a refrigerant stream at the first fluid outlet that includes the refrigerant in a liquid state (e.g., a ratio of vapor to liquid in the refrigerant may be less than a predetermined liquid value, such as less than 0.10).

A compressor setting may be determined (operation 605). The compressor(s) may be able to operate at more than one compressor setting (e.g., full load, part load). For example, a compressor may be capable of operating in more than one stage and/or more than one compressor may be utilized in a system (e.g., when more than one compressor is utilized, various stages may be generated by allowing and/or restricting operation of one or more of the compressors). Thus, a determination may be made as to which compressor setting the compressor(s) are operating. For example, the controller may determine one or more properties of the refrigerant in the discharge line from the compressor to determine the compressor setting. The controller may determine operating parameters of the compressor(s) (e.g., on/off, stage of operation, etc.) to determine a compressor setting and/or the controller of the system may determine the compressor setting using other appropriate techniques.

A setting for the heat exchanger may be determined based at least partially on the determined compressor setting (operation 610). A heat exchanger may include, but is not limited to, a first setting, a second setting, and/or a third setting. For example, a first setting for the heat exchanger, in which a first pass includes a first flow path, may be selected for a first compressor setting, in which a full load is allowed. A second setting for the heat exchanger, in which a first pass includes a first flow path and a second flow path, may be selected for a second compressor setting, in which a part load is allowed. In some implementations, a third setting for the heat exchanger, in which a first pass includes a first flow path, may be selected for a second compressor setting, in which a first part load is allowed, or a third compressor setting, in which a second part load (e.g., a second part load that is less than the first part load) is allowed.

An operation of the heat exchanger may be allowed utilizing the determined setting (operation 615). The heat exchanger may be configured based on the determined setting and operation of the heat exchanger may be allowed in the determined setting. For example, a determined setting may be compared to a current setting of the heat exchanger. If the determined setting is the same as the current setting of the heat exchanger, then adjustment of the setting and/or configuration of the heat exchanger may be restricted and the current setting of the heat exchanger may be maintained. If a determined setting is different from a current setting of the heat exchanger, then a configuration of the heat exchanger may be modified. For example, if the current setting includes allowing fluid flow through a second flow path and a determined setting includes restricting fluid flow through the second flow path, then a first valve which allows fluid flow to the second flow path may be closed.

Process 600 may be implemented by various systems, such as system 100. In addition, various operations may be added, deleted, and/or modified. In some implementations, process 600 may be performed in combination with other processes, such as process 200.

Figure 7:
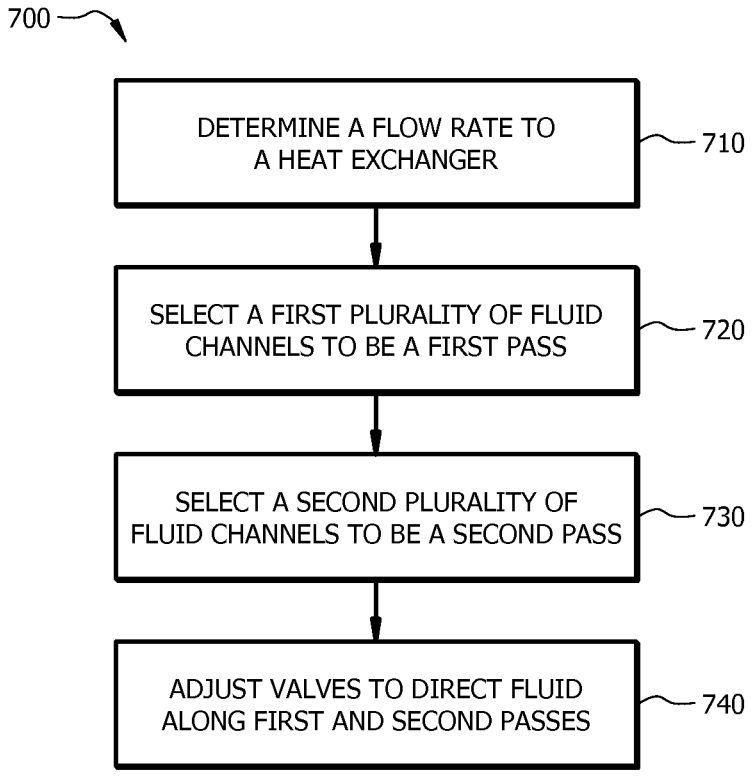
FIG. 7 illustrates an implementation of an examples process for operation of heat exchanger.

FIG. 7 displays a process for implementing an embodiment of the invention. First, a flow rate is determined for a heat exchanger 710. Then, based on the flow rate, a first plurality of fluid channels are selected to comprise a first pass 720 and a second plurality of fluid channels are selected to comprise a second pass 730. Finally, valves in the heat exchanger are adjusted to direct a fluid along the first and second passes 740.

In some implementations, determining a setting of a heat exchanger may be based on properties of the heat exchanger, system, and/or portions thereof. For example, determining a setting of a heat exchanger may be based on one or more properties (e.g., temperature, pressure, vapor pressure, flow rate, type of first fluid etc.) of a first fluid inlet. Determining a setting of a heat exchanger may be based on one or more properties (e.g., temperature, pressure, vapor pressure, flow rate, type of first fluid etc.) of a first fluid outlet and/or of the first fluid in one or more portions of the heat exchanger (e.g., first set of manifolds and/or second set of manifolds). Determining a setting of a heat exchanger may be based on one or more properties (e.g., temperature, pressure, flow rate, type of first fluid, etc.) of the airflow.

In some implementations, determining a setting of a heat exchanger may be based on a determination of whether changes have occurred in the system in which the heat exchanger resides. A determination may be made by a controller of the system (e.g., an air conditioner and/or refrigeration system) whether a change has occurred. For example, the controller may determine and/or monitor one or more properties of the system and determine whether a change has occurred. In some implementations, a change may be compared to a retrieved criteria of heat exchanger settings to determine whether to adjust a setting based on the change. For example, a controller may determine that ice exists on the fan of a condenser housing. However, when the controller retrieves the criteria and compares the determined change to the retrieved criteria, the controller may determine that the ice on the fan does not satisfy the criteria to cause the controller to determine a setting of the heat exchanger. In some implementations, a controller may determine that a setting of the compressor has changed from part load to full load. The controller may retrieve the criteria and compare the determined change (e.g., compressor load change) to the retrieved criteria to determine that the determined change has satisfied the criteria. When the determined change satisfies the criteria, the controller may determine a setting of the heat exchanger.

In some implementations, a determination may be made whether a refrigerant stream exiting a first pass of a condenser has a vapor property in a first property range. For example, the degree of mixing of the vapor with the liquid (e.g., degree of homogeneity) may be determined and compared to a predetermined value (e.g., stored in a memory of the controller). The setting may be adjusted and/or restricted from being adjusted based at least partially on the determination of whether the vapor property is in the first property range. In some implementations, a liquid level in the second set of manifolds may be determined. A setting selected may be based on a liquid level in the second manifold. If the liquid level is below a predetermined liquid level, then a setting may be adjusted. For example, a setting may be selected such that the second pass may include flow paths below the liquid level and/or proximate the top of the liquid level. In some implementations, the flow paths above a liquid level may be restricted from being associated with the second pass (e.g., fluid flow through this flow path may be restricted and/or this flow path may be associated with the first pass).

In some implementations, a first pass may allow fluid to flow in a first direction and a second pass may allow fluid to flow in a second opposite direction.

In some implementations, an adjustable heat exchanger may be utilized with systems in which the first fluid properties at the inlet of the heat exchanger vary. For example, when one or more compressors are utilized in a system, the properties of the first fluid at the inlet of the heat exchanger may vary based on the load of the compressor(s). When the system includes more than one fan and/or multi-speed fan(s) (e.g., two-speed fan and/or variable speed fan) to provide fluid flow to the heat exchanger and/or other heat exchangers in the system, the properties of the first fluid at the inlet of the heat exchanger may vary based on the speed at which the fan(s) are allowed to operate. When the system includes adjustable expansion valves, the properties of the first fluid at the inlet of the heat exchanger may vary based on the amount of fluid allowed to flow through the expansion valve. Thus, when the first fluid properties fluctuate at the first inlet of the heat exchanger, by allowing the heat exchanger to adjust, performance may be increased (e.g., condensation may be more complete when the heat exchanger is acting as a condenser) and/or problems may be minimized.

For example, a change may be determined (e.g., in a setting of a component in which the heat exchanger operates). For example, a change in the first fluid at the first fluid inlet may be determined (e.g., when compared to previous first fluid properties, which may be stored in a memory of the system). A setting of the heat exchanger may be determined based on the determined change and/or one or more properties of the system. The setting may be compared to the current setting of the heat exchanger to determine whether to adjust the configuration (e.g., the valve positions) of the heat exchanger and the heat exchanger may be adjusted if a determined setting is different from the current setting. The heat exchanger may thus be allowed to operate at the determined setting. A controller of the system and/or the heat exchanger may perform one or more of these determinations and/or retrieve appropriate information (e.g., for comparisons, for associations of for example, valves and settings, settings and conditions in which settings should be allowed, and/or any other appropriate data).

Although a specific controller has been described in FIG. 1, the controller may be any appropriate computer or other programmable logic device. The controller may include a processor that executes instructions (e.g., modules) and manipulates data to perform operations of the controller. Processor may include a programmable logic device, a microprocessor, or any other appropriate device for manipulating information in a logical manner and memory may include any appropriate form(s) of volatile and/or nonvolatile memory, such as RAM and/or Flash memory.

The memory may include instructions and/or data, such as predetermined property values (e.g., temperatures and/or pressures); tables of associations to determine settings; and/or any other data useful to the operation of the air conditioner.

In addition, various software may be stored on the memory. For example, instructions (e.g., operating systems and/or other types of software) may be executed by a processor of the controller. The instructions, including an operation module and/or an adjustment module, may be stored on the memory. The operation module may operate the air conditioner and/or components thereof during normal operations (e.g., operations in which the system operates based at least partially on user requests for operation). The adjustment module may perform one or more of the operations in processes 200, 600, portions thereof, and/or combinations thereof. For example, the adjustment module may determine properties; retrieve predetermined property values ranges of values, and/or criteria; compare values and/or criteria; determine settings; determine configurations associated with determined settings; determine whether to retrieve a table of associations between properties (e.g., compressor loads, properties of the heat exchanger, and/or properties of the system) and settings; allow heat exchanger operation at a determined setting; and/or other operations.

In some implementations, modules may be combined, such as into a single module or multiple modules. Operation modules and/or adjustment modules may be distinct modules. In an implementation, operation modules and/or adjustment modules may include various modules and/or submodules.

A communication interface may allow the controller to communicate with components of the system, other repositories, and/or other computer systems. The communication interface may transmit data from the controller and/or receive data from other components, other repositories, and/or other computer systems via network protocols (e.g., TCP/IP, Bluetooth, and/or Wi-Fi) and/or a bus (e.g., serial, parallel, USB, and/or Fire Wire). Operations of the system stored in the memory may be updated and/or altered through the communication via network protocols (e.g., remotely through a firmware update and/or by a device directly coupled to the controller).

The controller may include a presentation interface to present data to a user, such as though a monitor and speakers. The presentation interface may facilitate receipt of requests for operation from users.

A client (e.g., control panel in field or building) may allow a user to access the controller and/or instructions stored on the controller. The client may be a computer system such as a personal computer, a laptop, a personal digital assistant, a smart phone, or any computer system appropriate for communicating with the controller. For example, a technician may utilize a client, such as a tablet computer, to access the controller. As another example, a user may utilize a client, such as a smart phone, to access the controller and request operations.

Although FIG. 1 provides one example of controller that may be used with the disclosure, controller can be implemented through computers such as servers, as well as a server pool. For example, controller may include a general-purpose personal computer (PC) a Macintosh, a workstation, a UNIX-based computer, a server computer, or any other suitable device. In some implementations, a controller may include a programmable logic device. For example, the controller may be mounted to a wall of a location in which air conditioning may be provided. According to one implementation, controller may include a web server. Controller may be adapted to execute any operating system including UNIX, Linux, Windows, or any other suitable operating system. Controller may include software and/or hardware in any combination suitable to provide access to data and/or translate data to an appropriate compatible format.

Various implementations of the systems and techniques described herein can be realized in digital electronic circuitry, integrated circuitry, specially designed ASICs (application specific integrated circuits), computer hardware, firmware, software, and/or combinations thereof. These various implementations can include implementations in one or more computer programs that are executable and/or interpretable on a programmable system, including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the term "machine-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable signal(s) may be non-transitory waves and/or non-transitory signals.

Although mechanical failure and mechanical failure events have been described as conditions that cause mechanical failure, conditions that precede mechanical failure may also be included, such as excessive wear on parts.

Although users have been described as a human, a user may be a person, a group of people, a person or persons interacting with one or more computers, and/or a computer system.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "a flow path" includes a combination of two or more flow paths and reference to "a conduit" includes different types and/or combinations of conduits.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A multi-pass heat exchanger comprising:

a fluid inlet arranged on a first side of the multi-pass heat exchanger;

a first pass operable to receive a fluid from the fluid inlet, wherein, for a first heat exchanger setting, the first pass comprises a first channel and a reversible channel;

a first manifold arranged on the first side of the multi-pass heat exchanger, the first manifold providing a connection, in the first heat exchanger setting, between the first channel and the reversible channel, the first manifold comprising:

a plurality of adjustable valves arranged on the first side of the multi-pass heat exchanger, wherein the plurality of adjustable valves are connected to at least the reversible channel, the plurality of adjustable valves operable to adjust a direction of fluid flow in the reversible channel;

a second manifold operable to receive the fluid from the first pass and direct the fluid to a second pass through the multi-pass heat exchanger, wherein, for the first heat exchanger setting, the second pass comprises a second channel; and a controller operable to:

determine one or more compressor settings of one or more compressors coupled to the multi-pass heat exchanger;

configure, based on a compressor load determined from the one or more compressor settings, the multi-pass heat exchanger for the first heat exchanger setting when the one or more compressors are operating at full load, wherein the multi-pass heat exchanger is configured for the first setting by adjusting the plurality of adjustable valves such that the first pass comprises the first channel and the reversible channel and the second pass comprises the second channel; and configure, based on the compressor load determined from the one or more compressor settings, the multi-pass heat exchanger for a second heat exchanger setting when the one or more compressors are operating at part load, wherein the multi-pass heat exchanger is configured for the second setting by adjusting the plurality of adjustable valves such that the first pass comprises the first channel and the second pass comprises the reversible channel and the second channel;

wherein the one or more compressors are operating at flail load when each of the one or more compressors is in operation and the one or more compressors are operating at part load when at least one of the one or more compressors is restricted from operation.

2. The multi-pass heat exchanger of claim 1 wherein the second manifold receives the fluid in a condensed state from the first plurality of channels.

3. The multi-pass heat exchanger of claim 1 wherein the plurality of adjustable valves comprises a first valve connected to the fluid inlet and a second valve connected to a fluid outlet of the multi-pass heat exchanger;

and the controller is operable to configure the multi-pass heat exchanger for the first heat exchanger setting by opening the first valve and closing the second valve.

4. The multi-pass heat exchanger of claim 1 wherein the plurality of adjustable valves comprises a first valve connected to the fluid inlet and a second valve connected to a fluid outlet of the multi-pass heat exchanger;

and the controller is operable to configure the multi-pass heat exchanger for the second heat exchanger setting by closing the first valve and opening the second valve.

5. The multi-pass heat exchanger of claim 1 wherein the multi-pass heat exchanger is a tube and fin heat exchanger.

6. The multi-pass heat exchanger of claim 1 wherein the second manifold comprises a plurality of holes to mechanically separate gas from fluid.

7. The multi-pass heat exchanger of claim 1 further com rising a fluid outlet connected to at least one of the plurality of adjustable valves.

8. The multi-pass heat exchanger of claim 1 further comprising a microprocessor, the microprocessor operable to adjust the plurality of adjustable valves.

9. A multi-pass heat exchanger comprising:

a fluid inlet;

a first manifold operable to receive a fluid from the fluid inlet;

a second manifold operable to direct the fluid from a first pass to a second pass;

a first channel and a reversible channel connecting the first and second manifolds and operable to allow airflow around the exterior of each channel, the first channel and the reversible channel comprising the first pass for a first heat exchanger setting;

a second channel connecting the first and second manifolds and operable to allow airflow around the exterior of each the second channel, the second channel comprising the second pass for the first heat exchanger setting;

an adjustable valve, the adjustable valve operable to switch the reversible valve from the first pass to the second pass; and a controller operable to:

determine one or more compressor settings of one or more compressors coupled to the multi-pass heat exchanger;

configure, based on a compressor load determined from the one or more compressor settings, the multi-pass heat exchanger for the first heat exchanger setting when the one or more compressors are operating at full load, wherein the multi-pass heat exchanger is configured for the first setting by adjusting the adjustable valve such that the first channel and the reversible channel comprise the first pass and the second channel comprises the second pass; and configure, based on the compressor load determined from the one or more compressor settings, the multi-pass heat exchanger for a second heat exchanger setting when the one or more compressors are operating at part load, wherein the multi-pass heat exchanger is configured for the second setting by adjusting the adjustable valve such that the first pass comprises the first channel and the reversible channel and the second pass comprise the second channel;

wherein the one or more compressors are operating at full load when each of the one or more compressors is in operation and the one or more compressors are operating at part load when at least one of the one or more compressors is restricted from operation.

10. The multi-pass heat exchanger of claim 9 wherein the second manifold receives the fluid in a condensed state from the first pass.

11. The multi-pass heat exchanger of claim 9 wherein the fluid is refrigerant.

12. The multi-pass heat exchanger of claim 9 wherein the multi-pass heat exchanger is a tube and fin heat exchanger.

13. The multi-pass heat exchanger of claim 9 wherein the second manifold comprises a plurality of holes to mechanically separate gas from fluid.

14. The multi-pass heat exchanger of claim 9 further comprising a fluid outlet connected to the adjustable valve.

15. The multi pass heat exchanger of claim 9 further comprising a microprocessor, the microprocessor operable to adjust the adjustable valve.

* * * * *